United States Patent [19]

Au

[11] Patent Number: 4,932,521

[45] Date of Patent: Jun. 12, 1990

[54] WATCH CASE WITH DEVICE FOR HOLDING BOOKLET

[75] Inventor: Ho C. Au, Hong Kong, Hong Kong

[73] Assignee: Hover Force Industries Limited, Hong Kong

[21] Appl. No.: 384,640

[22] Filed: Jul. 25, 1989

[51] Int. Cl.[5] ..... B65D 75/54

[52] U.S. Cl. ..... 206/232; 206/301

[58] Field of Search ..... 206/232, 301, 566, 6.1, 206/45.15, 45.16, 45.23, 45.19, 45.11, 44.12

[56] References Cited

U.S. PATENT DOCUMENTS

| | | | |
|---|---|---|---|
| 1,017,006 | 2/1912 | Lee . | |
| 1,425,508 | 8/1922 | Chapman | 206/566 X |
| 1,941,922 | 1/1934 | Worth . | |
| 2,269,676 | 1/1942 | McDonald | 206/45.15 |
| 2,580,141 | 12/1951 | Vidal . | |
| 2,716,484 | 8/1955 | Weppler . | |
| 2,926,866 | 3/1960 | Morin . | |
| 3,243,037 | 3/1966 | Luertzing . | |
| 3,385,423 | 5/1968 | Hayes . | |
| 3,679,047 | 7/1972 | Papirnyik . | |
| 3,809,216 | 5/1974 | Ferguson . | |
| 4,365,708 | 12/1982 | Tyus | 206/232 |
| 4,452,373 | 6/1984 | Pearce et al. . | |
| 4,470,488 | 9/1984 | Broussard . | |
| 4,773,530 | 9/1988 | Holtzman et al. | 206/232 |

FOREIGN PATENT DOCUMENTS

| | | | |
|---|---|---|---|
| 3013878 | 10/1981 | Fed. Rep. of Germany . | |
| 136699 | 2/1930 | Switzerland | 206/301 |
| 480680 | 11/1975 | U.S.S.R. . | |

*Primary Examiner*—William Price

*Attorney, Agent, or Firm*—Sandler, Greenblum & Bernstein

[57] ABSTRACT

A container for transporting and displaying a personal article, along with a printed publication. The container has a body and a cover which are pivotally connected together. A secondary chamber is formed below the body so as to create a cavity. An aperture is formed in a side of the second chamber to receive a slidable tray that is controlled by an activating means to move from a storage position to an extended position.

61 Claims, 6 Drawing Sheets

Fig. 1
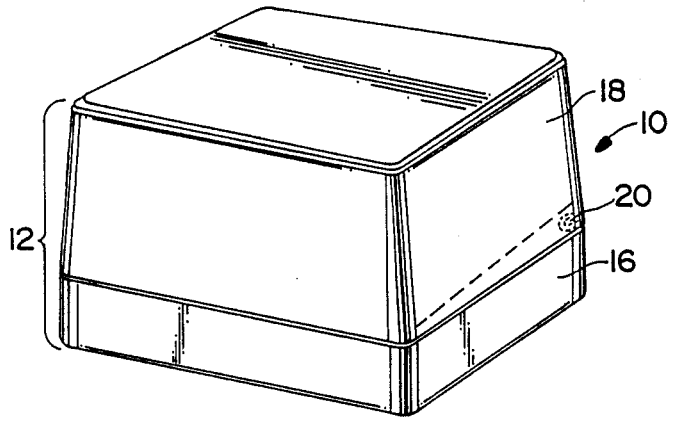
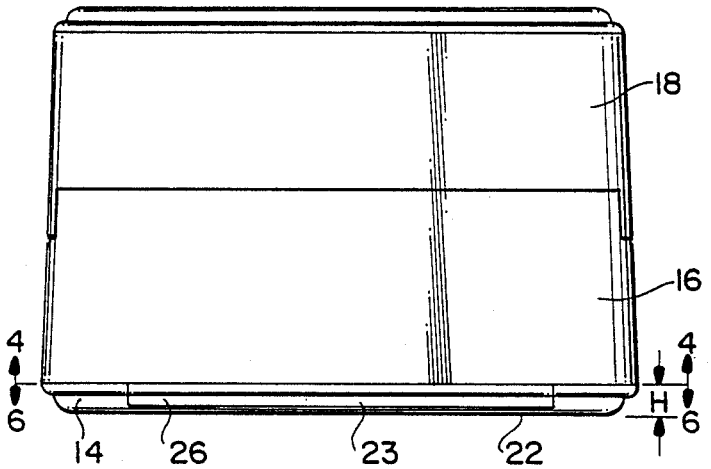
Fig. 2

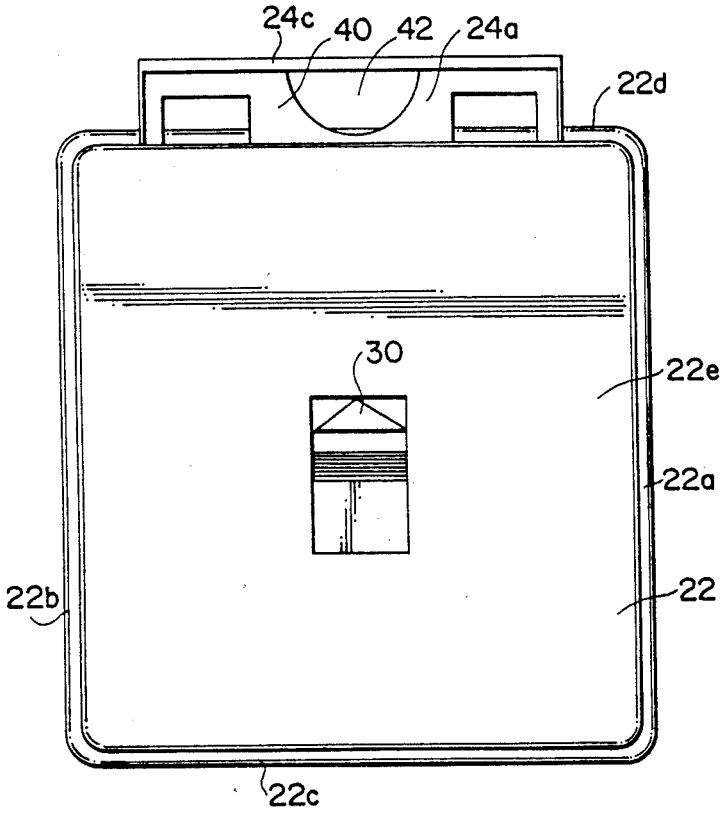
Fig. 3
Fig. 4
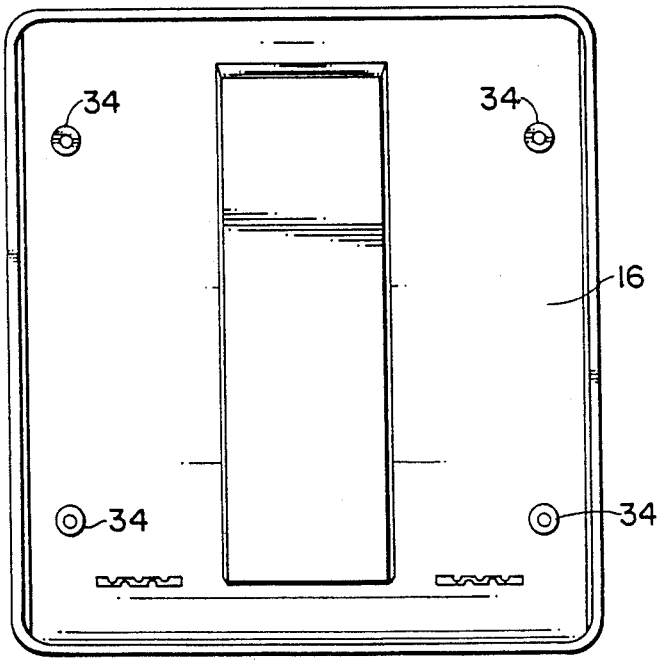
Fig. 5
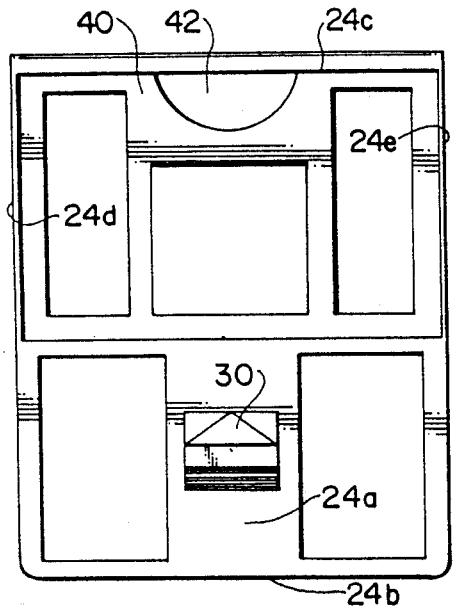

Fig. 10
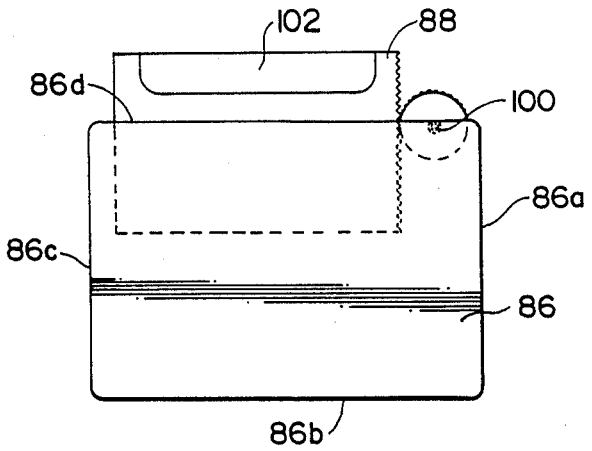
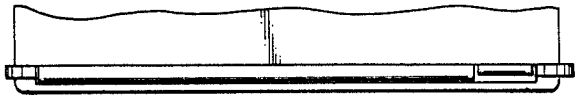
Fig. 14
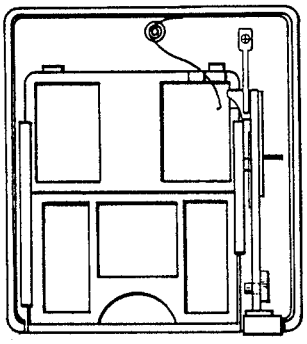
Fig. 15
Fig. 16
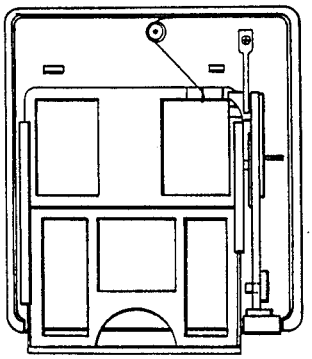

WATCH CASE WITH DEVICE FOR HOLDING BOOKLET

FIELD OF THE INVENTION

This invention relates to a storage box that is adapted to hold a personal item, such as a watch, and which storage box is provided with a compartment for holding a booklet (or other printed material) that is in some manner related to the personal item.

DESCRIPTION OF BACKGROUND AND RELEVANT INFORMATION

Various articles of manufacture, such as watches, are typically placed in a storage box for shipping and display purposes. Various printed materials, including printed publications, such as instruction manuals, assembly manuals, and guarantees, are typically included with the shipped articles. In the past, these printed materials were placed inside the storage box along with the manufactured article, or they were separately stored. In practice, the printed publication would be lost or mutilated after the storage box had been handled several times by prospective purchasers.

A solution to this problem was developed by HOLTZMAN, et al., U.S. Pat. No. 4,773,530, which created a secondary compartment on the bottom of the container for storage of the printed material. However, once the printed material is placed in this secondary compartment, it is difficult to remove. Hence, this led to the disadvantageous result that many people never examine what has been placed in the secondary compartment.

In view of the above, it is accordingly an object of the present invention to provide a slidable tray upon which printed material can be placed, the tray being housed inside a compartment of the storage box when it is not in use.

An advantage of the present invention is the provision of an aperture in the tray through which a person's finger can be inserted for the purpose of removing the printed matter from the tray.

Another advantage of the present invention is the provision of a tray that can be manipulated from outside the storage container for moving the tray from a storage position to an extended, use position.

SUMMARY OF THE INVENTION

A container for transporting and displaying a personal article, along with a printed publication. The container has a body and cover which are pivotally connected together. A secondary chamber is formed below the body so as to create a cavity. An aperture is formed in a side of the secondary chamber to receive a slidable tray which is controlled by an activating mechanism to move the tray from a storage position to an extended, use position.

According to one aspect of the invention, there is provided a container for transporting and displaying personal articles of manufacture, in which the container is accompanied by a printed document. The container comprises a body and a cover, with the cover being movable between a closed and an open position. A secondary chamber is located below the body so as to form a cavity, and the secondary chamber includes a first aperture through a side of the secondary chamber. The container is further provided with a transporting means that is located within the cavity of the secondary chamber, which transporting means is operable to move from a storage position to an extended position by traveling through said first aperture. Additionally, actuating means are provided for controlling movement of said transporting means between said storage position and said extended position.

A second aperture may be formed in the secondary chamber, with the second aperture being substantially orthogonal to the first, and receiving the actuating means.

The transporting means may comprise a slidable tray, and the first aperture may be dimensioned so that its width and height are slightly greater than the width and height of said slidable tray. The secondary chamber may be provided with means limiting the range of movement of the slidable tray, such as a U-shaped ridge within the secondary chamber. Moreover, the slidable tray can include an access aperture port therein for receiving a finger, as well as a depression therein for receiving the printed publication.

The actuating means may comprise a rotary gear. This rotary gear can be provided with an outer circumference that contains a plurality of teeth, with the teeth engaging a plurality of ribs associated with a side of said transporting means. Furthermore, the rotary gear may be positioned in a horizontal plane along with the transporting means, with a portion of the rotary gear being located inside said cavity and a portion of the rotary gear protruding through the first aperture in the secondary chamber. Relating to this, a second aperture may be in the secondary chamber, with the second aperture being substantially orthogonal to said first aperture. In such an instance, the rotary gear is positioned in a horizontal plane along with the transporting means, and a portion of the rotary gear may be located inside the cavity and a portion of the rotary gear may protrude through the second aperture in the secondary chamber. In such an instance, the rotary gear may have a width that is slightly greater than that of the transporting means.

Additionally, there may be provided friction means for inhibiting movement of the transporting means; the actuating means may be located proximate the aperture; and the cover may be pivotably connected to the body.

According to another aspect of the invention, a container for transporting and displaying personal articles of manufacture may be provided, with the container being intended to be accompanied by a printed document. This container includes a body and a cover, with the cover being movable between a closed and an open position. A secondary chamber is located below the body so as to form a cavity, and the secondary chamber includes an aperture through a side of said secondary chamber. A transporting means is located within the cavity of the secondary chamber that is operable to move from a storage position to an extended position by traveling through the aperture. Additionally, an actuating means is operable to initiate movement of the transporting means.

In this embodiment of the invention, the transporting means may be a slidable tray, and the first aperture can have a height that is slightly greater than the height of the slidable tray. Further, the secondary chamber can include means for limiting the range of movement of the slidable tray, such as at least one protrusion that is positioned to limit rearward movement of the slidable tray so that the slidable tray has its front portion flush with an outer wall portion of the secondary chamber at the first aperture. Furthermore, a slot and a protrusion positioned in said slot may be included for limiting the extent of travel of the slidable tray into the extended position.

The slidable tray may contain an access aperture therein for receiving a finger, and a depression for receiving a printed publication.

The actuating means may include a lever having a detent that is engageable with a recess in the slidable tray, and a first spring biasing the slidable tray toward the extended position. The lever can include a journal and a front flanged portion, with the front flanged portion being located in the first aperture adjacent to the slidable tray. A first spring may be provided for maintaining the detent in the recess. Moreover, the slidable tray may include a bracket having a flanged portion, and a second spring may be mounted so as to be slidable through the flanged portion on the bracket. Means for preventing lateral movement of the lever, such as in the form of two walls located on opposite sides of the lever, may also be provided. The journal may be pivotably mounted on a protrusion within the secondary chamber.

Brackets can be mounted on the secondary chamber through which the slidable tray may slide. Furthermore, the secondary chamber may include a lip for attachment of the secondary chamber to the body.

According to another aspect of the invention, there is provided a chamber for holding printed matter, which chamber is capable of being attached to a container that is utilized for transporting and displaying personal articles of manufacture. This chamber may be constructed in a similar manner to the secondary chamber described above, and may include all of the same elements.

BRIEF DESCRIPTION OF THE DRAWINGS

The foregoing and other objects, features, and advantages of the invention will be apparent from the following more specific description of the preferred embodiments of the invention, as illustrated in the accompanying drawings in which reference characters refer to the said parts throughout the different views. The drawings are not necessarily to scale, emphasis instead being placed upon illustrating principles of the invention in a clear manner.

FIG. 1 is a perspective view of a first embodiment of a storage container in a closed position;

FIG. 2 is a back view of the storage container of FIG. 1, showing the placement of a booklet storage tray;

FIG. 3 is a bottom view of the storage container of FIG. 1, showing a storage tray in an extended position;

FIG. 4 is a cross-sectional view of the storage case of FIG. 2, taken along line 4—4;

FIG. 5 is a bottom view of a storage tray used with the first embodiment;

FIG. 10 is a top view of the third embodiment of FIG. 9 showing a storage tray in an extended position;

FIG. 14 is a partial front view of a fifth embodiment of a storage container according to the invention;

FIG. 15 is a top view of the secondary chamber of the fifth embodiment of the invention in its retracted, storage position; and FIG. 16 is a top view of the secondary chamber of the fifth embodiment of the invention in its extended, use position.

DETAILED DESCRIPTION OF THE DRAWINGS

Figure 6:
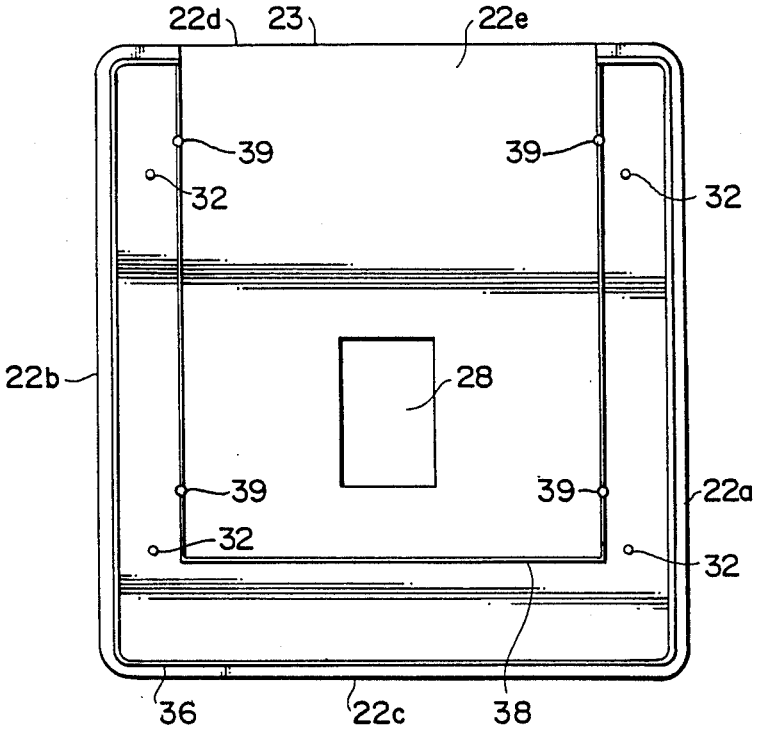
FIG. 6 is an inside view of the bottom portion of the storage container of the first embodiment shown in FIG. 2, taken along line 6—6.

In the ensuing section, five embodiments of a storage container having a compartment and a slidable tray for holding printed matter are described, with FIGS. 1–8 depicting first and second embodiments, and FIGS. 9–16 depicting third, fourth and fifth embodiments. Specific details of these five embodiments will be presented in the sections that follow.

FIRST EMBODIMENT

FIG. 1 illustrates a first embodiment of a storage container 10 comprising an article of manufacture storage compartment 12 and a printed matter storage compartment 14. The container 10 is manufactured out of any suitable durable material, such as plastic.

The article of manufacture storage compartment 12 comprises a body 16 and a cover 18. The construction of the body 16 and, cover .18 are conventional in shape and construction, and may readily be varied. In this first embodiment, the cover 18 is pivotably connected to the body 16 using a side mounted ball and socket arrangement 20.

The printed matter storage compartment 14 comprises a secondary chamber 22 and a slidable tray 24. The secondary chamber 22 is dimensioned to be compatible with the bottom dimensions of the article of manufacture storage compartment 12. The secondary chamber 22 of the first embodiment has four sides, **22*a*, 22*b*, 22*c*, and 22*d*, which are perpendicular to base portion 22*e*. The sides have a height H, which in the first embodiment is approximately ⅜ of an inch. Thus, when the secondary chamber 22 is attached to the bottom of the body 16, a cavity 26 is created. A first aperture 23 is formed in side wall 22*d* of the secondary chamber 22 to receive the tray 24, to be discussed below. The size of the first aperture 23 is selected to be slightly larger than the width and height of the tray 24. A second aperture 28 (FIG. 6) is placed in the base 22*e* of the secondary chamber 22 for an actuating means, such as a sliding lever 30, to be discussed below. In the first embodiment, the aperture 28 is rectangular in shape, having a length L and a width W. The aperture 28 extends from a point approximately midway between sides 22*c* and 22*d* to a point approximate side 22*c* and is approximately centered between sides 22*a* and 22*b***.

Inside surface **22*e* of the secondary chamber 22 of the printed matter storage compartment 14 has a plurality of perpendicularly mounted pins 32, which mate with receptacles 34 located on the bottom of the article of manufacture storage compartment 12. In addition, a lip 36 is provided which permits the printed matter storage compartment 14 to snap into the bottom of the article of manufacture storage compartment 12, so as to create a seamless appearance when the storage container 10** is assembled. It is understood that various methods of assembly can be employed.

A U-shaped ridge 38 is formed on the inside surface of the secondary chamber 22. This 38 assists in the placement of the slidable tray 24 onto the chamber 22 during assembly. The ridge 38 also assists in defining the limits of movement of the slidable tray 24. In addition, the ridge 38 has a plurality of dimples 39, which act as a friction producing means upon the slidable tray 24.

The slidable tray 24 of the first embodiment is rectangular in appearance, having four sides 24*b*, 24*c*, 24*d* and 24*e*, and a top side 24*a*. The dimensions of the slidable tray 24 are not critical; it merely having to be smaller than the inside dimensions of the printed matter storage compartment 14. Top side 24*a* of the slidable tray 24 has a sliding lever 30 that is positioned proximate side 24*b* of the tray 24. A depression 40 is formed in the tray 24 from approximately the midpoint of the tray to near side 24*c* and from side 24*d* to side 24*e*. Again, the exact dimensions of the depression 40 are not critical. An access port 42 is formed in the tray proximate side 24*c*, the purpose of which will be explained below.

The printed matter storage compartment 14 is assembled to the article of manufacture storage compartment 12 as follows:

The top side 24*a* of the slidable tray 24 is placed proximate the inside surface 22*e* of the secondary chamber 22 within the confines of the raised ridge 38, so that the sliding lever 30 protrudes into the aperture 28 of the secondary chamber 22. The pins 32 of the secondary chamber 22 are then mated to the corresponding receptacles 34 on the bottom of the article of manufacture storage compartment 12.

In use, a personal article of manufacture, such as a watch, is placed inside the storage container 10. The sliding lever 30 is manipulated so as to extend the tray 24 through the first aperture 23 to an extended position. A printed publication, such as instructions and/or warranty information, is placed onto the tray 24 so that it sits in the depression 40. The sliding lever 30 is manipulated to retract the publication into the cavity 26 for storage purposes. An owner or customer can examine the printed document by operating the lever 30 so as to extend the slidable tray 24 to the extended position. To remove the publication from the depression 40, the person places one of his fingers through the access port 42 in the slidable tray, so as to raise a portion of the publication off of the tray. The person can then grab the printed matter with his remaining fingers and remove the material from the secondary chamber 22. The dimples 39 act against the sides 24*d* and 24*e* of the tray 24 so as to create a frictional surface which prevents the slidable tray 24 from unintentionally moving from a storage position to an extended position.

SECOND EMBODIMENT

Figure 8:
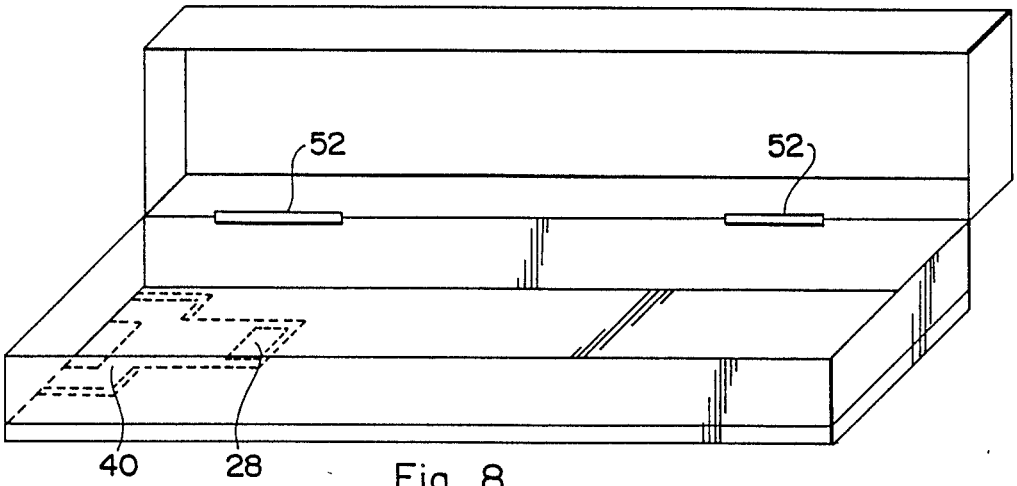
FIG. 8 is a perspective view of the second embodiment of FIG. 7 in an open position.
Figure 7:
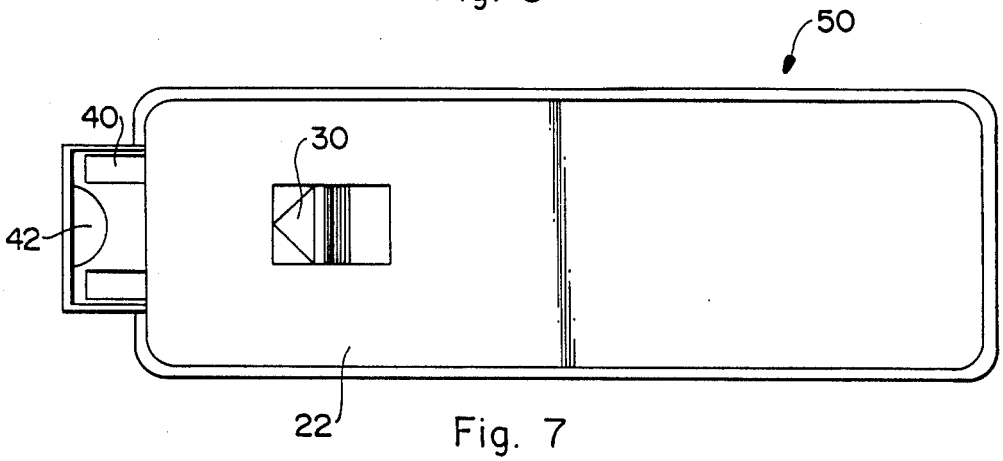
FIG. 7 is a bottom view of a storage container of a second embodiment.
Figure 9:
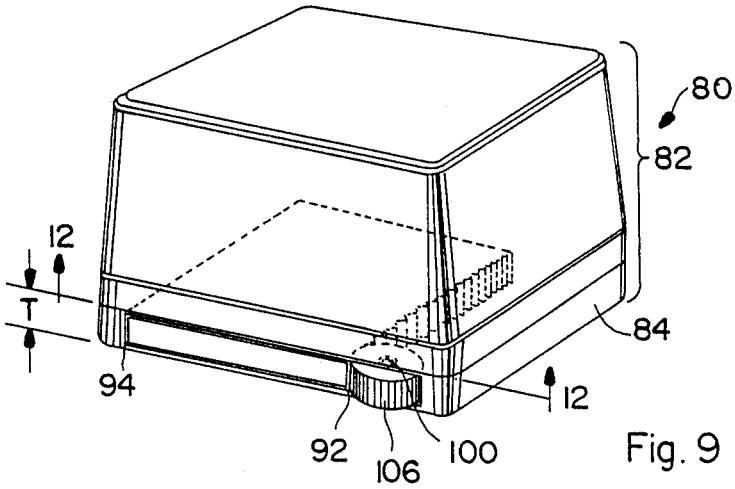
FIG. 9 is a perspective view of a third embodiment of the invention in a closed position.
Figure 11:
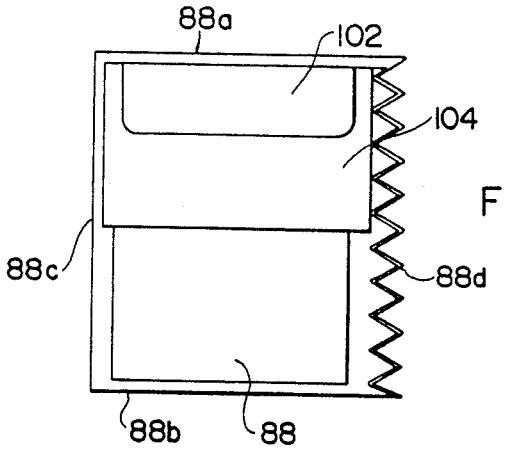
FIG. 11 is a bottom view of a storage tray used with the third embodiment of the invention.

A second embodiment, as illustrated in FIGS. 7 and 8, incorporating a storage container 50 (FIG. 8) varies from the first embodiment in only two respects. First, the storage container 50, which is rectangular in shape, has the slidable tray protruding from a side of the storage container. Second, a living hinge 52 has been substituted for the ball and socket arrangement 20 of the first embodiment.

THIRD EMBODIMENT

A third embodiment according to the present invention is shown in FIGS. 9 to 12. As with the previous embodiments, storage container 80 comprises an article of manufacture storage compartment 82 and a printed matter storage compartment 84. In the third embodiment, the article of manufacture storage compartment 82 is similar to the article of manufacture storage compartment 12 of the first embodiment. Thus, a discussion of the construction of the storage compartment 82 will not be repeated. Similarly, it is understood that the printed matter storage compartment 84 of the third embodiment can be employed with the article of manufacture storage compartment of the second embodiment.

The printed matter storage compartment 84 comprises a secondary chamber 86, a slidable tray 88 and an actuating means, such as a rotary gear 90. These components are manufactured from any suitable material, such as plastic.

Figure 12:
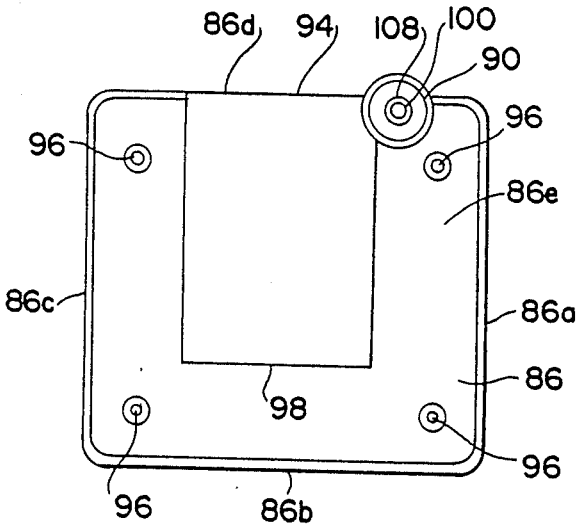
FIG. 12 is a cross-sectional view of the storage case of FIG. 9 along lines 12—12.

The secondary chamber 86 is dimensioned to mate with the bottom surface of the article of manufacture storage compartment 82. The secondary chamber 86 has four sides 86*a*, 86*b*, 86*c*, 86*d* which are perpendicular to bottom portion 86*e*. The sides have a height T, so that when the secondary chamber 86 is attached to the bottom of the article of manufacture storage compartment 82, a cavity 92 is created. A cut-out 94 is formed in side 86*d* of the secondary chamber 86 for acceptance of the slidable tray 88. The dimensions of the cut-out 94 is selected so as to be slightly larger than the dimensions of the slidable tray 88 and rotary gear 90. As shown in FIG. 12, the inside surface of the bottom portion 86*e* has a plurality of pins 96 which are used to attach the secondary chamber 86 to the bottom of the article of manufacture storage compartment 82.

A U-shaped ridge 98 is formed on the inside surface of the bottom portion 86*e*. The slidable tray 88 fits within the area defined by the U- shaped ridge. Lastly, a pivot pin 100 is provided on the inside surface of the bottom portion 86*e* for receiving the rotary gear 90, which will be described below.

The slidable tray 88 of the third embodiment comprises a rectangularly shaped piece of material, such as plastic, having a front end 88*a*, a rear end 88*b*, a straight side 88*c* and a ribbed side 88*d*. An aperture 102 is formed in the tray 88 proximate the front end 88*a* of the slidable tray. The aperture 102 permits a user to easily remove a document from the tray. If desired, a depression 104 can be formed in the top surface of the slidable tray 88 so that the document will be seated within the tray 88.

The rotary gear 90 has a circular circumference and a flat top and bottom. The circumference of the rotary gear 90 includes of teeth 106, which are configured to engage the ribbed side 88*d* of the slidable A hole 108 is formed through the top and bottom surface of the wheel 90 to engage with the pivot pin 100 located on the secondary chamber 86.

To assemble the storage container 80, the rotary gear 90 is placed onto the pivot pin 100. The slidable tray is then placed on top of the inside surface of the bottom portion 86*e* of the secondary chamber 86 so that the teeth 106 on the rotary gear 90 engage the ribbed side 88*d* of the tray 88. The pins 96 are then aligned with complementary receptacles (not shown) on the bottom of the article of manufacture storage compartment 82 and the two units are sealed together.

To use the printed matter storage compartment 84 portion of the storage container 80, the rotary gear 90 is rotated in one direction so as to extend the slidable tray to an extended position. To easily remove a document located on the slidable tray 88, a person's finger is inserted through the aperture 102. This raises an end portion of the document off the tray 88, making it easier to remove. To retract the tray 88 to its storage position, one merely rotates the rotary gear 90 in the opposite direction.

FOURTH EMBODIMENT

Figure 13:
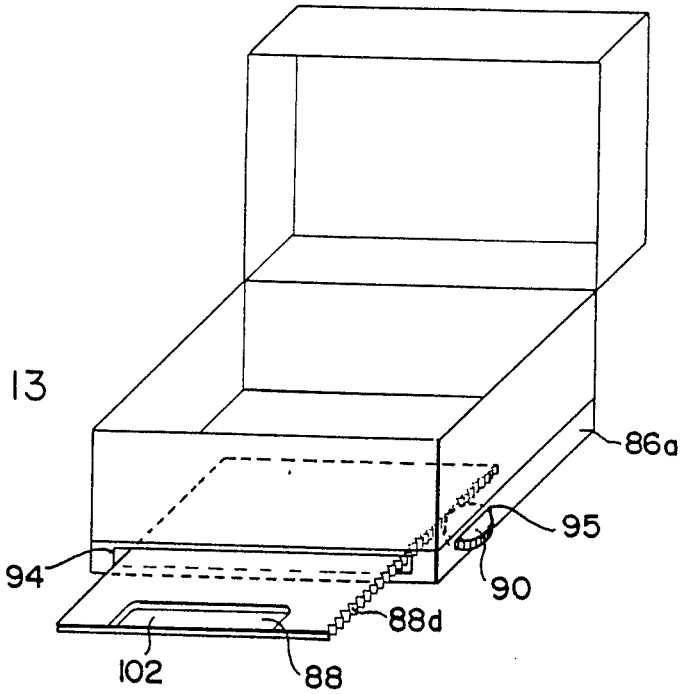
FIG. 13 is a perspective view of a fourth embodiment of a storage container according to the invention.

A fourth embodiment according to the present invention is shown in FIG. 13. This embodiment is similar to the third embodiment with the exception of the placement of the rotary gear 90. In the fourth embodiment, a second cut-out 95 is formed in side 86*a* of the secondary chamber 86 and the rotary gear 90 is placed on a pivot pin (not shown) located proximate the second cut-out 95 so that the gear 90 protrudes through the second cut-out 95. As shown in FIG. 13, the second cut-out 95 is perpendicular to the cut-out 94. Because the rotary gear 90 has been moved from the position shown in the third embodiment, to the position shown in FIG. 13, the dimensions of the cut-out 94 is selected to be slightly larger than the dimensions of the slidable tray 88.

FIFTH EMBODIMENT

A fifth embodiment according to the present invention is shown in FIGS. 14–16. As with the previous embodiments, storage container 110 comprises an article of manufacture storage compartment 112, and a printed matter storage compartment 114. In the fifth embodiment, the article of manufacture storage compartment 112 is similar to the article of manufacture storage compartment 12 and 82 of the first and third embodiments, respectively, Thus, a discussion of the construction of the storage compartment 112 will not be repeated. Similarly, it is understood that the printed matter storage compartment 114 of the fifth embodiment can be employed with the article of manufacture storage compartment of any of the other embodiments, such as the second embodiment.

The printed matter storage compartment 114 comprises a secondary chamber 116, a slidable tray 118, and an actuating means 120. These components are manufactured from any suitable material, such as plastic.

The secondary chamber 116 is dimensioned to mate with the bottom surface of the article of manufacture storage compartment 112. The secondary chamber 116 has four sides 116*a*, 116*b*, 116*c*, 116*d* which are perpendicular to bottom portion 116*e*. The sides have a height T', so that when the secondary chamber 116 is attached to the bottom of the article of manufacture storage compartment 112, a cavity 122 is created. A cut-out 124 is formed in side 116*d* of the secondary chamber 116 for acceptance of the slidable tray 118. The dimensions of the cut-out 124 are selected so as to be slightly larger than the dimensions of the slidable tray 118 and the actuating means 120; however, any reasonable thickness T, greater than the thickness of the tray 118 and the actuating means 120 may be utilized.

As shown in FIGS. 15 and 16, the printed matter storage compartment 116 may include a lip 126, which permits the printed matter storage compartment 116 to snap into the bottom of the article of manufacture storage compartment 112, so as to create a seamless appearance when the storage container 110 is assembled. It is understood that other methods of assembly can be employed without diverting from the scope of the invention. Furthermore, the bottom portion 116*e* may include a plurality of pins, which may be utilized to attach the secondary printed matter storage compartment 116 to the manufacture storage compartment 112 in a similar manner to that discussed for the previously-described embodiments.

The slidable tray 118 for the fifth embodiment comprises a rectangularly-shaped piece of material, such as plastic, having a front end 118*a*, a rear end 118*b*, and two sides 118*c* and 118*d*. An access aperture 128 formed in the slidable tray 118 proximate the front end 118*a* permits a user to easily remove a document from the slidable tray. Additionally, the slidable tray 118 may include a recessed portion 130 formed in its top surface, and proximate the front end 118*a*, thereby permitting the printed matter to be seated within the slidable tray.

Positioned on the upper surface 132 of the bottom portion 116*e* of the printed matter storage compartment 116 are two brackets 134 and 136. The two brackets 134 and 136 are mounted on the upper surface 132 at a distance that is slightly greater than the distance between side walls 118*c* and 118*d* of the slidable tray 118 so that the that the slidable tray 118 can slide from a retracted, storage position to an extended, use position.

Stop means 138 are positioned proximate the rear wall 116*c* of the printed matter storage compartment to limit the extend of travel of the slidable tray 118 into its retracted, storage position. In other words, when the slidable tray 118 is pushed into the cut-out 124, the stop means 138 prevent further movement of the slidable tray. Preferably, the stop means 138 are positioned so as to control rearward movement of the slidable tray 118 so that the front wall 118*a* of the slidable tray 118 is flush with the front wall 116*d* of the printed matter storage container 116.

Additionally, a mechanism 140 for controlling the forward movement of the slidable tray into its extended, use position is included within the printed matter storage compartment 116. The mechanism 140 may include a protrusion 142 that is positioned within a slot 144. The length of the slot 144 is dimensioned to permit the slidable tray 118 to obtain its retracted, storage position against the stop means 138, and to control the extent of forward travel into the extended, use position of the slidable tray 118. More specifically, the slot 144 includes a back wall portion 146, which when contacted by the protrusion 142 prevents further forward movement of the slidable tray 118. The extent of movement, and hence the length of the slot 144, is not critical, but should be sufficient to permit a person to raise a portion of the printed matter from the recess portion 130 by placing a finger into the access aperture 128.

The actuating means 120 include a lever 148 including a detent 150, a journal 152, and a front flanged portion 154. The journal 152 is pivotably mounted on post 153, such as in a recess portion on the post 153. The detent portion fits into a recess 156 located proximate the rear wall 118*b* on the slidable tray 118. The detent 150 is maintained within the recess 156 by a spring 158 that is mounted by a screw 160 to the bottom portion 116*e*. For example, the spring 158 may be mounted on a protrusion. Furthermore, a spring 164 acting to bias the slidable tray towards its extended, use position is mounted on protrusion 166. A bracket 168 is positioned on the rear wall 118*b* of the slidable tray 118. The bracket 168 includes a flanged portion 170 through which the spring 164 is adapted to slide. Accordingly, as the slidable tray 118 slides towards its extended, use position, the spring 164 slides through the bracket 168 under the flanged portion 170 until the slidable tray 118 reaches its extended, use position. At such time, an end portion 172 of the spring 164 is positioned under the flanged portion 170. Lateral movement of the lever 148 is substantially prevented by walls 174 and 176 positioned on opposite sides of the lever 148.

The storage container 110 may be easily assembled by sliding the slidable tray 118 through brackets 134 and 136, and positioning the lever 148, between the walls 174 and 176, with its journal 152 positioned in the post 153. At this time the spring 158 may be mounted with screw 160 onto protrusion 162, while ensuring that the spring 158 is positioned so as to bias the detent 150 into the recess 156, and the spring 164 is positioned under the flanged portion 170 of the bracket 168. The printed matter storage compartment may then be attached in any suitable manner to the bottom of the article of manufacture storage compartment 112, such as by the use of pins and receptacles as previously described.

To use the printed matter storage compartment 114 portion of the storage container 110, the front flanged portion 154 of the lever 148 is pressed in a downward direction utilizing a finger, such as the thumb, to thereby pivot the lever 148 around the journal 152 against the downward bias of spring 158. When detent 150 is lifted out of the recess 156, the spring 164 forces the slidable tray forward to the extended, use position (as illustrated in FIG. 16) at which point the protrusion 142 contacts rear wall portion 146 of the slot 144. To easily remove the printed matter located on the slidable tray 118, a person's finger is inserted under and through the access aperture 128. This raises an end portion of the printed matter off the slidable tray 118, making it easier to remove. To retract the slidable tray 118, to its storage position, one merely pushes the slidable tray 118 into the printed matter storage compartment 116 until the slidable tray hits the stop means 138, at which time the detent enters the recess 156 due to the bias of the spring 158, as illustrated in FIG. 15

While the invention, as illustrated in FIGS. 9–16, has been specifically shown and described with reference to the preferred embodiments, it will be understood by those skilled in the art that various changes in form and detail may be made therein without departing from the spirit and scope of the invention.

The embodiments of the invention in which an exclusive property or privilege is claimed are defined as follows:

1. A container for transporting and displaying personal articles of manufacture, in which said container is accompanied by a printed document, said container comprising:

a body and a cover, said cover being movable between a closed and an open position;

a secondary chamber, said secondary chamber being located below said body so as to form a cavity, said secondary chamber having a first aperture through a side of said secondary chamber;

transporting means, said transporting means being located within said cavity of said secondary chamber and being operable to move from a storage position to an extended position by traveling through said first aperture; and actuating means for controlling movement of said transporting means between said storage position and said extended position.

2. The device according to claim 1, wherein said actuating means comprises a rotary gear.

3. The device according to claim 2, wherein said rotary gear has an outer circumference that contains a plurality of teeth, said teeth engaging a plurality of ribs associated with a side of said transporting means.

4. The device according to claim 3, wherein said rotary gear is positioned in a horizontal plane along with said transporting means, a portion of said rotary gear being located inside said cavity and a portion of said rotary gear protruding through said first aperture into said secondary chamber.

5. The device according to claim 2, wherein a second aperture is formed in said secondary chamber, said second aperture being substantially orthogonal to said first aperture, said second aperture receiving said rotary gear.

6. The device according to claim 5, wherein a portion of said rotary gear is located inside said cavity and a portion of said rotary gear protrudes through said second aperture into said secondary chamber.

7. The device according to claim 6, wherein said rotary gear has a width that is slightly greater than that of the transporting means.

8. The device according to claim 2, wherein said first aperture includes dimensions that are slightly greater than the width and height of said transporting means.

9. The device according to claim 8, wherein said transporting means comprises a slidable tray.

10. The device according to claim 9, wherein said secondary chamber includes means for limiting the range of movement of said slidable tray.

11. The device according to claim 10, wherein said means for limiting the range of movement of said slidable tray comprises a U-shaped ridge within the secondary chamber.

12. The device according to claim 9, wherein said slidable tray has an access aperture port therein for receiving a finger.

13. The device according to claim 9, wherein said slidable tray has a depression therein for receiving a printed publication.

14. The device according to claim 12, wherein said slidable tray has a depression therein for receiving a printed publication.

15. The device according to claim 1, further comprising friction means for inhibiting movement of said transporting means.

16. The device according to claim 1, wherein said actuating means is located proximate said aperture.

17. The device according to claim wherein said cover is pivotably connected to said body.

18. A container for transporting and displaying personal articles of manufacture, in which said container is accompanied by a printed document, said container comprising:

a body and a cover, said cover being movable between a closed and an open position;

secondary chamber, said secondary chamber being located below said body so as to form a cavity, said secondary chamber having an aperture through a side of said secondary chamber;

transporting means, said transporting means being located within said cavity of said secondary chamber and being operable to move from a storage position to an extended position by traveling through said aperture; and actuating means, said actuating means being operable to initiate movement of said transporting means.

19. The device according to claim 18, wherein said transporting means comprise a slidable tray.

20. The device according to claim 19, wherein said first aperture has a height that is slightly greater than the height of said slidable tray.

21. The device according to claim 19, wherein said secondary chamber includes means for limiting the range of movement of said slidable tray.

22. The device according to claim 21, wherein said means for limiting the range of movement of said slidable tray comprises at least one protrusion.

23. The device according to claim 21, wherein said at least one protrusion is positioned to limit rearward movement of said slidable tray so that said slidable tray has its front portion flush with an outer wall portion of said secondary chamber at said first aperture.

24. The device according to claim 21, wherein said means for limiting the range of movement of said slidable tray includes a slot, and said secondary chamber includes a protrusion that is positioned in said slot for limiting the extent of travel of said slidable tray into the extended position.

25. The device according to claim 21, wherein said means for limiting the range of movement of said slidable tray includes, (a) at least one protrusion positioned to limit rearward movement of said slidable tray so that said slidable tray has its front portion flush with an outer wall portion of said secondary chamber at said first aperture when in its storage position; and (b) a slot and a protrusion positioned in said slot for limiting the extent of travel of said slidable tray into the extended position.

26. The device according to claim 19, wherein said slidable tray has an access aperture therein for receiving a finger.

27. The device according to claim 21, wherein said slidable tray has an access aperture therein for receiving a finger.

28. The device according to claim 19, wherein said slidable tray has a depression therein for receiving a printed publication.

29. The device according to claim 27, wherein said slidable tray has a depression therein for receiving a printed publication.

30. The device according to claim 19, wherein said actuating means include a lever having a detent that is engageable with a recess in said slidable tray, and a first spring biasing said slidable tray toward the extended position.

31. The device according to claim 30, wherein said lever further includes a journal and a front flanged portion.

32. The device according to claim 31, wherein said front flanged portion is located in said first aperture adjacent to said slidable tray.

33. The device according to claim 32, further including a first spring for maintaining said detent in said recess.

34. The device according to claim 33, wherein said slidable tray includes a bracket having a flanged portion, and a second spring is mounted so as to be slidable through said flanged portion on said bracket.

35. The device according to claim 34, further including means for preventing lateral movement of said lever.

36. The device according to claim 35, wherein said means for preventing lateral movement of said lever comprise two walls located on opposite sides of said lever.

37. The device according to claim 36, wherein said secondary chamber includes a protrusion, and said journal is pivotably mounted on said protrusion.

38. The device according to claim 19, further including brackets mounted on said secondary chamber through which said slidable tray is adapted to slide.

39. The device according to claim 19, wherein said secondary chamber includes a lip.

40. A chamber for holding printed matter, and capable of being attached to a container that is utilized for transporting and displaying personal articles of manufacture, said chamber comprising:

a body having a bottom portion that is surrounded by four sides, which four sides include a front side and a rear side, with said bottom portion and said four sides forming a cavity;

a first aperture located in said front side;

transporting means, said transporting means being located within said cavity of said chamber and being operable to move from a storage position to an extended position by traveling through said first aperture; and actuating means, said actuating means being operable to initiate movement of said transporting means.

41. The device according to claim 40, wherein said transporting means comprise a slidable tray.

42. The device according to claim 41, wherein said first aperture has a height that is slightly greater than the height of said slidable tray.

43. The device according to claim 41, wherein said secondary chamber includes means for limiting the range of movement of said slidable tray.

44. The device according to claim 43, wherein said means for limiting the range of movement of said slidable tray comprises at least one protrusion.

45. The device according to claim 43, wherein said at least one protrusion is positioned to limit rearward movement of said slidable tray so that said slidable tray has its front portion flush with an outer wall portion of said secondary chamber at said first aperture.

46. The device according to claim 43, wherein said means for limiting the range of movement of said slidable tray includes a slot, and said secondary chamber includes a protrusion that is positioned in said slot for limiting the extent of travel of said slidable tray into the extended position.

47. The device according to claim 43, wherein said means for limiting the range of movement of said slidable tray includes, (a) at least one protrusion positioned to limit rearward movement of said slidable tray so that said slidable tray has its front portion flush with an outer wall portion of said secondary chamber at said first aperture when in its storage position; and (b) a slot and a protrusion positioned in said slot for limiting the extent of travel of said slidable tray into the extended position.

48. The device according to claim 41, wherein said slidable tray has an access aperture therein for receiving a finger.

49. The device according to claim 43, wherein said slidable tray has an access aperture therein for receiving a finger.

50. The device according to claim 41, wherein said slidable tray has a depression therein for receiving a printed publication.

51. The device according to claim 49, wherein said slidable tray has a depression therein for receiving a printed publication.

52. The device according to claim 43, wherein said actuating means include a lever having a detent that is engageable with a recess in said slidable tray, and a first spring biasing said slidable tray toward the extended position.

53. The device according to claim 52, wherein said lever further includes a journal and a front flanged portion.

54. The device according to claim 53, wherein said front flanged portion is located in said first aperture adjacent to said slidable tray.

55. The device according to claim 54, further including a first spring for maintaining said detent in said recess.

56. The device according to claim 55, wherein said slidable tray includes a bracket having a flanged portion, and a second spring is mounted so as to be slidable through said flanged portion on said bracket.

57. The device according to claim 56, further including means for preventing lateral movement of said lever.

58. The device according to claim 57, wherein said means for preventing lateral movement of said lever comprise two walls located on opposite sides of said lever.

59. The device according to claim 58, wherein said secondary chamber includes a protrusion, and said journal is pivotably mounted on said protrusion.

60. The device according to claim 43, further including brackets mounted on said secondary chamber through which said slidable tray is adapted to slide.

61. The device according to claim 43, wherein said secondary chamber includes a lip.

* * * * *

UNITED STATES PATENT AND TRADEMARK OFFICE

CERTIFICATE OF CORRECTION

PATENT NO. : 4,932,521
DATED : June 12, 1990
INVENTOR(S) : Ho C. AU

It is certified that error appears in the above-indentified patent and that said Letters Patent is hereby corrected as shown below:

At column 6, line 58, change "slidable" to ---slidable tray 88---.

At column 7, line 63, change "T," to ---T'---.

At column 10, line 54 (claim 17, line 1), change "claim" to ---claim 1,---.

Signed and Sealed this

Twenty-first Day of February, 1995

*Attest:*

*Attesting Officer*

BRUCE LEHMAN

*Commissioner of Patents and Trademarks*